US006033476A

United States Patent [19]

Masukawa et al.

[11] Patent Number: 6,033,476

[45] Date of Patent: Mar. 7, 2000

[54] COATING APPARATUS

[75] Inventors: Junichi Masukawa; Nobuyuki Isshiki; Nobunori Ohji, all of Tokyo; Eiten Chin; Toshiharu Numata, both of Ichigai-machi, all of Japan

[73] Assignee: Kao Corporation, Tokyo, Japan

[21] Appl. No.: 08/636,520

[22] Filed: Apr. 23, 1996

Related U.S. Application Data

[62] Division of application No. 08/294,741, Aug. 23, 1994, Pat. No. 5,534,065.

[30] Foreign Application Priority Data

Aug. 23, 1993 [JP] Japan ..... 5-227856
May 6, 1994 [JP] Japan ..... 6-116056

[51] Int. Cl.[7] ..... B05C 3/02

[52] U.S. Cl. ..... 118/411; 118/419

[58] Field of Search ..... 118/410, 411, 118/419; 427/356

[56] References Cited

U.S. PATENT DOCUMENTS 5,324,357 6/1994 Okuno et al. ..... 118/411

*Primary Examiner*—Brenda A. Lamb

*Attorney, Agent, or Firm*—Oblon, Spivak, McClelland, Maier & Neustadt, P.C.

[57] ABSTRACT

A coating apparatus comprises an upstream lip and a downstream lip defining a slot between the two lips through which a coating liquid can be extruded; and a pair of guide rollers disposed on opposite side of the lips for guiding a support to move past the lips such that the coating liquid can be applied thereto, wherein the downstream lip has a coating operation surface facing and curved toward the support and, a curvature k of the curved coating operation surface being given as $$P_2/T \leq k \leq P_1/T$$

where T represents the tension in the coated portion of the support, and $P_1$ and $P_2$ represent the pressures of the coating liquid acting on the support at upstream and downstream ends of said coating operation surface.

1 Claim, 9 Drawing Sheets

COATING APPARATUS

This is a division of application Ser. No. 08/294,741 filed Aug. 23, 1994, now U.S. Pat. No. 5,534,065.

BACKGROUND OF THE INVENTION

1. Field of the Invention

This invention relates to a coating apparatus for coating a coating liquid on a running support and, more particularly, to a coating apparatus for coating a magnetic dispersoid on a flexible support.

2. Discussion of the Related Art

Recently, to meet a demand for increased thin film coating speed, extrusion type coating apparatuses have been adopted in various fields (such as those according to the inventions disclosed in Japanese Patent Laid-Open Publications No. Sho 58-104666, No. Sho 60-238179, No. Sho 62-117666 and No. Hei 2-265672). These extrusion type coating apparatuses have their head (hereinafter referred to as die head) provided with an upstream and a downstream lip. A slot is defined between these lips such that a coating liquid (for instance a magnetic dispersoid) can be extruded through it to be coated on a support running past the upstream and downstream lips.

FIGS. 8A and 9A show prior art extrusion type coating apparatuses. As shown, the apparatus 1 or 11 has an upstream lip 2 or 12 and a downstream lip 3 or 13. The downstream lip 3 or 13 has an end surface 7 or 17 (coating operation surface) having a straight or single arcuate sectional (constant radius of curvature) profile. One of the reasons for this shape is simplicity of processing. More specifically, the downstream lip 3 or 13 is made of a super-hard alloy or like very hard material, and high machining accuracy (in the order of sub-microns) is required for it. For this reason, the coating operation surface of the downstream lip 3 or 13 is limited to a planar or single arcuate surface. Reference numerals 4 and 14 in FIGS. 8A and 9A designate slots.

The coating operation surface 7 or 17 of the downstream lip 3 or 13, however, is very closely related to coating operation conditions such as the coating speed, coating film thickness, kind of coating liquid, etc. Therefore, the shape of the coating operation surface has to be determined by taking these coating operation conditions into consideration.

For example, in the coating apparatus 1 in which the downstream lip 3 has a flat coating operation surface 7, as shown in FIGS. 8A and 8B, the pressure of the coating liquid 6 which is extruded into the space between the coating operation surface 7 of the downstream lip 3 and the support 5, and which acts on the support 5, is concentratedly at a support position facing to the upstream end of the coating operation surface 7 (point B), i.e., a position on the support which is intersected by a plane forming an extension of the downstream wall of the slot 4 and passing through the point B and at a support position facing to a position immediately upstream of the downstream end (point C). The pressure of the coating liquid 6 must be set to be above a predetermined value at the support position facing to the point B in order to prevent the air entraining into the coating film. However, for the other positions it is desirable for the liquid pressure to be low for reducing the load acting on the support 5. For this reason, in this coating apparatus 1, the ranges of the coating operation conditions which permit satisfactory coating are very narrow.

In the coating apparatus 11 in which the downstream lip 13 has a single arcuate coating operation surface 17, as shown in FIGS. 9A and 9B, the pressure of the coating liquid 6 extruded into the space between the coating operation surface 7 of the downstream lip 13 and the support 5 and acting on the support 5 is not concentrated at the support position facing to a position immediately upstream of the point C, but unnecessary pressure is produced between the points B and C. For this reason, when the coating operation conditions are changed slightly, the coating liquid pressure is changed as shown by the dashed curve in FIG. 9B to increase the load acting on the support 5. Therefore, in the case of the coating apparatus 11, the ranges of the coating operation conditions that permit satisfactory coating are again narrow.

SUMMARY OF THE INVENTION

The invention has been completed in view of the above circumstances, and its object is to provide a coating apparatus which can extend the ranges of coating operation conditions that permit satisfactory coating.

According to the invention, there is provided a coating apparatus, which comprises an upstream lip and a downstream lip for coating a coating liquid extruded through a slot defined between the two lips on a support running past the lips and a pair of guide rollers disposed on the upstream and downstream sides of the coating apparatus, the downstream lip having a coating operation surface facing and curved toward the support and in contact with the coating liquid, the curvature k of the curved coating operation surface being given as $$P_2/T \leqq k \leqq P_1/T$$

where T represents the tension in the coated portion of the support, and $P_1$ and $P_2$ represent the pressure of the coating liquid acting on the support at the upstream and downstream ends of the coating operation surface.

According to the invention, there is also provided a coating apparatus, which comprises an upstream lip and a downstream lip for coating a coating liquid extruded through a slot defined between the two lips on a support running past the lips and a pair of guide rollers disposed on the upstream and downstream sides of the coating apparatus for pushing the support against the coating apparatus, the downstream lip having a coating operation surface facing and curved toward the support and in contact with the coating liquid, the coating operation surface having a shape expressed by a cubic function $$y=ax^3+bx^2+cx \text{ (a, b and c being constants)}$$

in coordinates with the origin set at the upstream end of the downstream lip, the x axis taken to be parallel to the tangent to the pair guide rollers with the downstream side direction being the positive direction, and the y axis taken to be perpendicular to the x axis with the direction opposite to the direction of extrusion of the coating liquid from the slot being the positive direction.

According to the invention, the following functions and effects are obtainable.

When the distance between the coating operation surface for forming a coating film and the support running past that surface via the coating liquid becomes non-uniform in the direction of coating, an unnecessary pressure is generated to result in a coating operation condition range reduction or in generation of coating irregularities. For this reason, the support is suitably caused to run substantially along the coating operation surface, and it is suitable to maintain the coating operation surface and the support parallel to each other.

With the coating apparatus according to the invention, the curvature k of the coating operation surface is set to $$P_2/T \leqq k \leqq P_1/T$$

where T is the tension in the support, $P_1$ is the liquid pressure at the upstream end of the coating operation surface, and $P_2$ is the liquid pressure at the downstream end of the coating operation surface. Thus, the pressure of the coating liquid extruded into the space between the coating operation surface and the support is maximum at the upstream end of the coating operation surface, gradually reduced toward the downstream side and is minimum at the downstream end.

Further, with the coating apparatus according to the invention, the coating operation surface is formed such that its shape is expressed as a cubic function $$y=ax^3+bx^2+cx \text{ (a, b and c being constants)}$$

to maintain the coating surface and the support parallel to each other. Thus, the pressure of the coating liquid extruded into the space between the coating operation surface and the support is maximum at the upstream end of the coating operation surface, is gradually reduced toward the downstream side without generation of unnecessary pressure and is minimum at the downstream end. Thus, even when the pressure of the coating liquid between the coating operation surface and the support is varied due to variations of the coating operation conditions such as the coating speed, coating liquid viscosity, etc., the support and the coating operation surface can be held parallel, and the liquid pressure variations can be held within a permissible range. It is thus possible to further extend the coating operation condition ranges that permit satisfactory coating.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, wherein.

DETAILED DESCRIPTION OF THE PREFERRED EMBODIMENTS

Now, embodiments of the invention will be described with reference to the drawings.

First Embodiment

Figure 1:
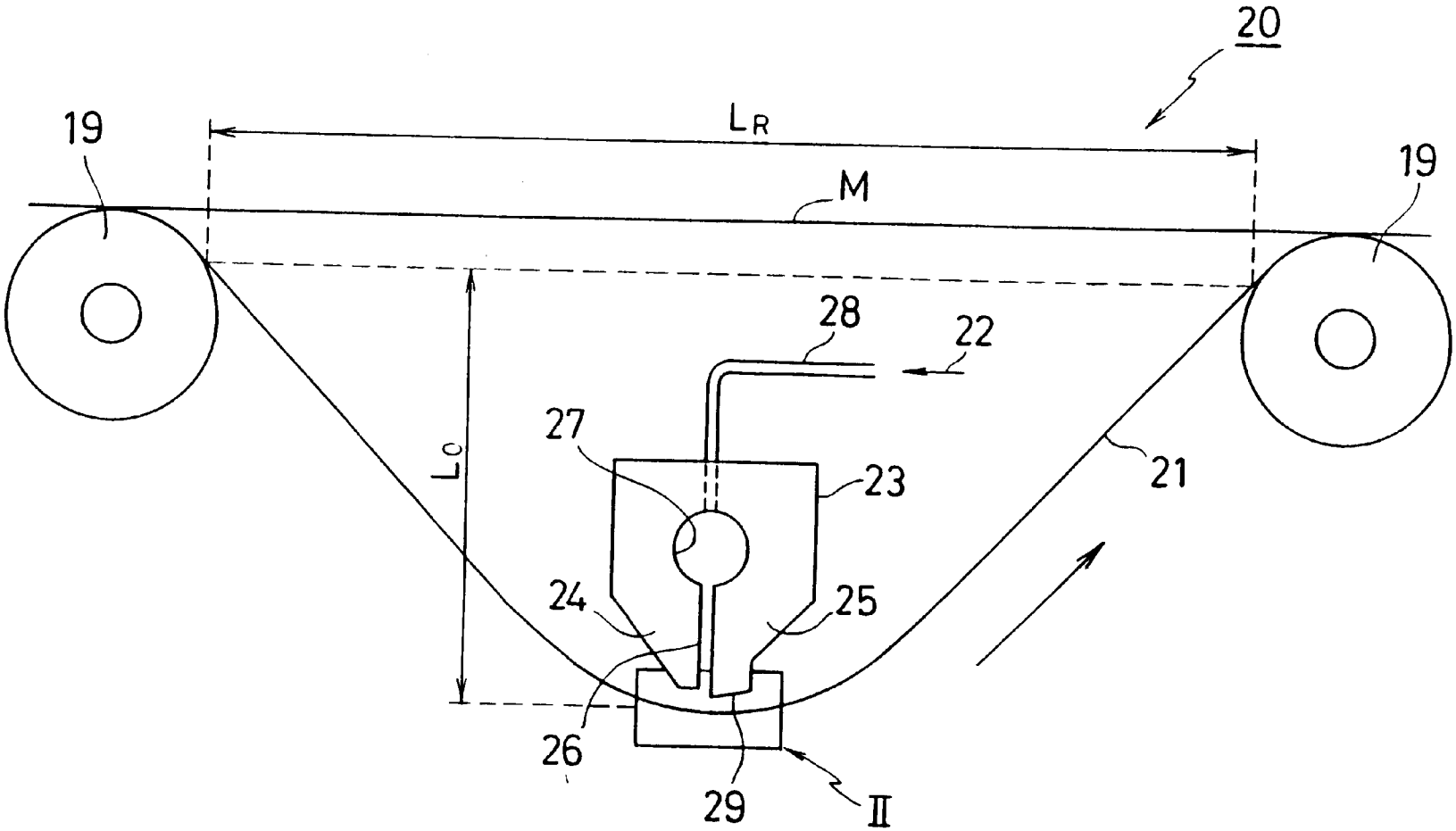
FIG. 1 is a sectional view showing a first embodiment of the coating apparatus according to the invention, particularly a die head of the apparatus.
Figure 2A:
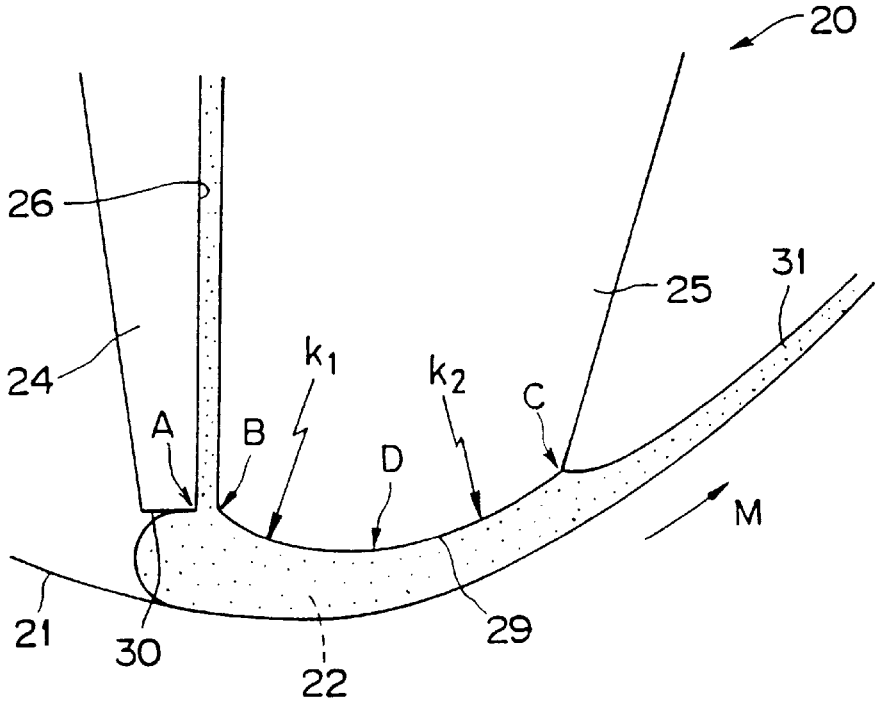
FIG. 2A is an enlarged-scale sectional view showing a coating end section shown in FIG. 1.
Figure 2B:
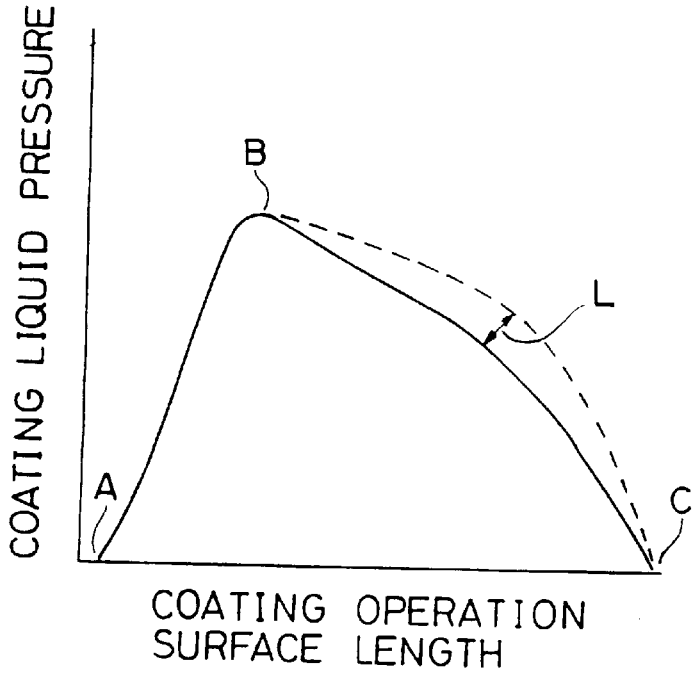
FIG. 2B is a graph showing the relation between coating liquid pressure and coating operation surface length in the coating apparatus shown in FIG. 2A.

FIG. 1 is a sectional view showing an essential part of a first embodiment of the coating apparatus according to the invention. FIG. 2A is an enlarged-scale sectional view showing a portion (shown at II) in FIG. 1. FIG. 2B is a graph showing the relation between the pressure of coating liquid extruded into the space between coating operation surfaces 30 and 29 and a support 21 and coating operation surface length.

The coating apparatus 20 shown in FIG. 1 is an extrusion type coating apparatus for coating a coating liquid on a continuously running support. The support is a flexible sheet of such materials as plastics, paper, cloth, metals, etc. The coating liquid may be a magnetic dispersoid, a light-sensitive liquid, a thermosensitive dispersoid or an adhesive liquid for manufacturing a magnetic recording medium, a photographic film, heat-sensitive paper or an adhesive tape respectively. This embodiment concerns the case of manufacturing a magnetic recording medium by using magnetic dispersoid 22 as the coating liquid.

The coating apparatus 20 has a die head 23 having an upstream lip 24 and a downstream lip 25. A slot 26 is defined between these lips 24 and 25, and it is communicated with a liquid chamber 27. The lips 24 and 25 have substantially the same width as the width of the support 21. The slot 26 and liquid chamber 27 extend over the entire width of the lips 24 and 25.

The liquid chamber 27 is connected to a liquid supply system 28, and magnetic dispersoid 22 is supplied therefrom to the slot 26 at a constant rate in the coating width direction. The support 21 is guided by the guide rollers 19 to run past the upstream and downstream lips 24 and 25 without support of its back. Magnetic dispersoid 22 is extruded continuously from the slot 26 of the die head 23 and coated on the running support 21, whereby a coating film 31 is formed which is uniform in the width direction of the support 21.

The end surface of the downstream lip 25 which faces the support 21 and is in contact with magnetic dispersoid 22 serves as a coating operation surface 29 contributing to the coating. The coating operation surface 29 is curved such that it is convex toward the support 21, and it has two different curvatures $k_1$ and $k_2$. More specifically, a section of the coating operation surface 29 extending along the running direction of the support 21 from the upstream end B of the coating operation surface 29 (i.e., the open end of the slot 26) to an intermediate point D is a curved surface with a curvature $k_1$. A section of the coating operation surface 29 extending from the intermediate point D to the downstream end C of the coating operation surface is a curved surface with a curvature $k_2$. The curvatures $k_1$ and $k_2$ are set to be $$P_2/T \leqq k_1 \leqq P_1/T,$$

and $$P_2/T \leqq k_2 \leqq P_1/T,$$

where T is the tension in the support 21, and $P_1$ and $P_2$ are pressures of magnetic dispersoid 22 acting on the support 21 at the upstream and downstream ends B and C of the coating operation surface 29.

Thus, the pressure acting on the support 21 by the magnetic dispersoid 22 extruded into the space between the coating operation surface 29 of the downstream lip 25 and the support 21, as shown in FIG. 2B, is a maximum at a support position facing to the upstream end B of the coating operation surface 29 (i.e., the open end of the slot 26), is gradually reduced toward the downstream side and is a minimum at a support position facing to the downstream end C of the coating operation surface 29. Thus, even when the coating operation conditions such as the coating speed, coating film thickness, kind of coating, etc. are varied, the variations of the pressure of the coating liquid 22 between the coating operation surface 29 of the downstream lip 25 and the support 21 can be held within a small range L as shown by the dashed curve in FIG. 2B, and there is no possibility that the liquid pressure exceeds a predetermined value to increase the load acting on the support 21. Thus, it is possible to extend the coating operation condition ranges that permit satisfactory coating.

In the above first embodiment, the coating operation surface 29 was a composite surface comprising two curved surfaces with the different curvatures $k_1$ and $k_2$.

Second Embodiment

Figure 3:
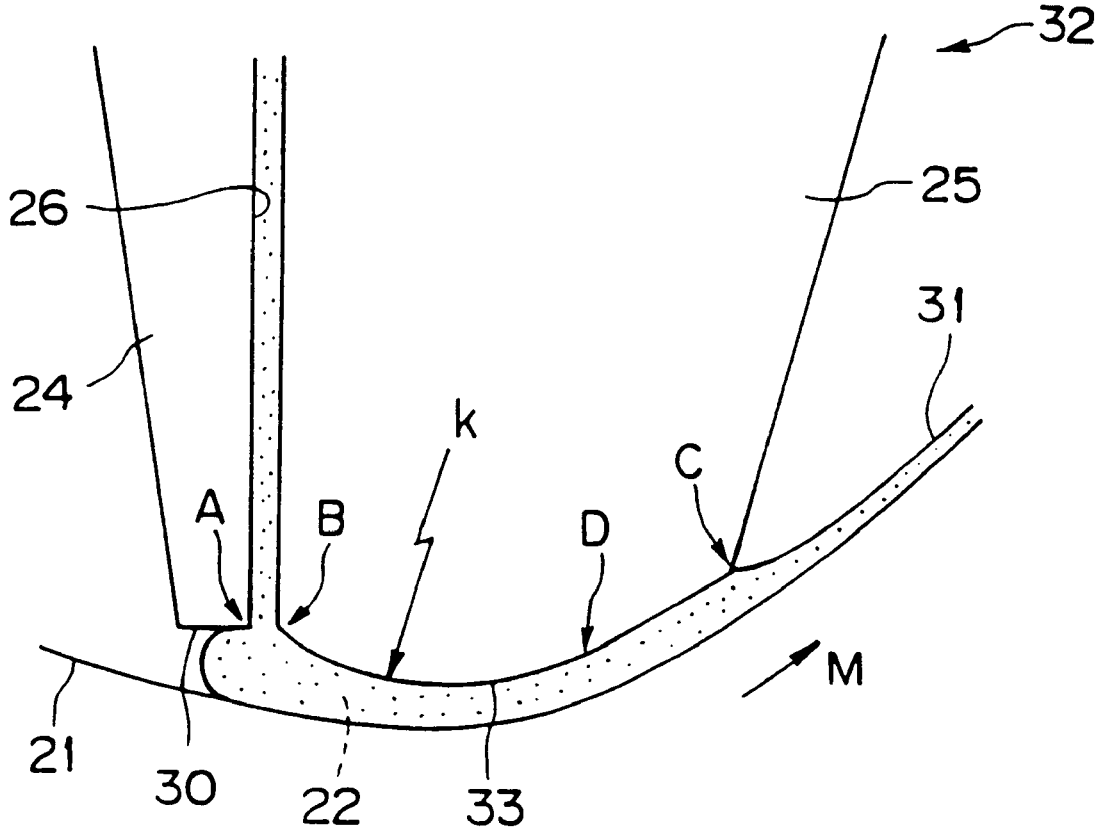
FIG. 3 is a sectional view showing a die head in a second embodiment of the invention.

FIG. 3 is a sectional view showing an essential part of a second embodiment of the coating apparatus according to the invention. In this embodiment, parts like those in the first embodiment are designated by same reference numerals and symbols, and their description is omitted.

In this embodiment of the coating apparatus 32, the coating operation surface 33 of downstream lip 25 is curved with a curvature k in a section BD extending in the running direction of support 21 and flat (with zero curvature) in a section DC. In this case, the curvature k is set to $$P_2/T \leqq k \leqq P_1/T$$

where T is the tension in the support 21, and $P_1$ and $P_2$ are pressures of magnetic dispersoid 22 acting on the support 21 at the upstream and downstream ends B and C of the coating operation surface 33.

Thus, again in this coating apparatus 32, like the first embodiment of the coating apparatus 20, the pressure acted on the support 21 by the magnetic dispersoid 22 extruded into the space between the coating operation surface 33 of the downstream lip 25 and the support 21 is shown by a curve similar to that shown in FIG. 2B. It is thus possible to extend the coating operation condition ranges that permit satisfactory coating.

Third Embodiment

Figure 4A:
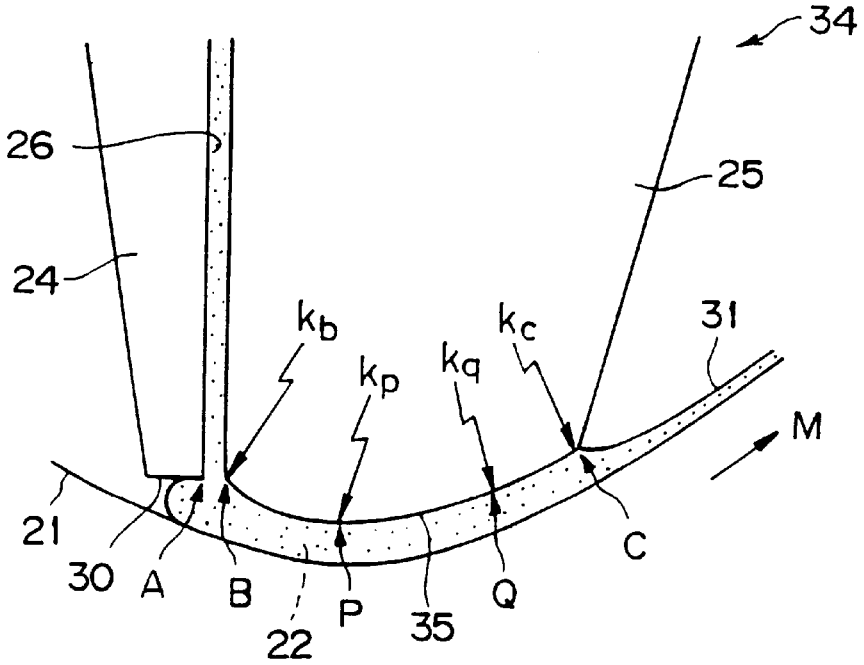
FIG. 4A is a sectional view showing a die head in a third embodiment of the invention.
Figure 4B:
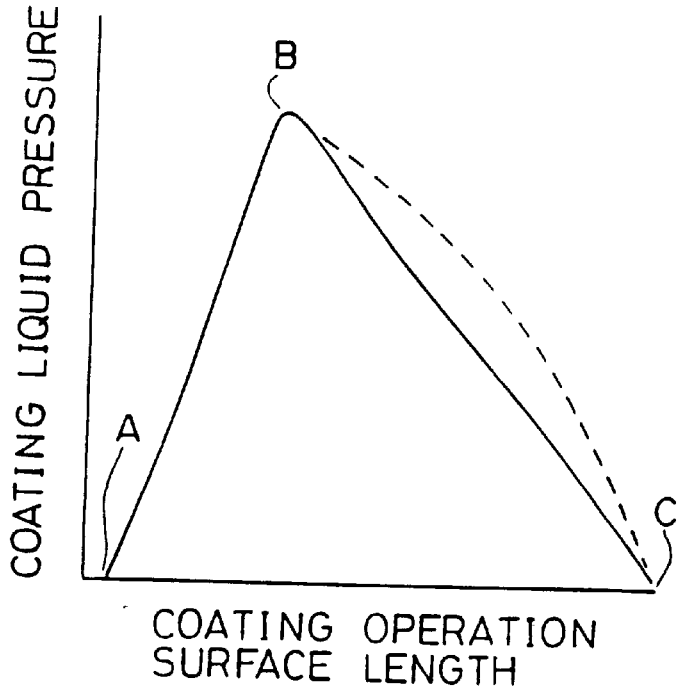
FIG. 4B is a graph showing the relation between coating liquid pressure and coating operation surface length in the coating apparatus shown in FIG. 4A.

FIG. 4A is a sectional view showing a portion of a die head in a third embodiment of the coating apparatus according to the invention. FIG. 4B is a graph showing the relation between the pressure of coating liquid extruded into the space between coating operation surfaces 30 and 35 and support 21 shown in FIG. 4A and the length of the coating operation surface. In this third embodiment, parts like those in the first embodiment are designated by same reference numerals and symbols, and their description is omitted.

In this third embodiment of the coating apparatus 34, the coating operation surface 35 of downstream lip 25 is curved to be convex toward support 21. Taking any two points P and Q on the coating operation surface 35, the curvature $k_p$ at the upstream side point P in the running direction of the support 21 and the curvature $k_q$ of the downstream side point Q are set to be $$k_p \leqq k_q.$$

These curvatures $k_p$ and $k_q$ are given as $$P_2/T \leqq k_p \leqq P_1/T,$$

and $$P_2/T \leqq k_q \leqq P_1/T,$$

where $P_1$ and $P_2$ are pressures of the magnetic dispersoid 22 at the upstream and downstream ends B and C of the coating operation surface 35, and T is the tension of the support 21.

In the coating operation surface 35, the curvature $k_b$ and $k_c$ of an upstream and a downstream end points B and C on the surface 35 are set as $$k_b = P_1/T$$

and $$k_c = P_2/T.$$

The individual curvature $k_p$, $k_q$, $k_b$ and $k_c$ are set to satisfy the above equations and are varied continuously along the surface 35.

Thus, the pressure acting on the support 21 by the magnetic dispersoid 22 extruded into the space between the coating operation surface 35 and the support 21, as shown in FIG. 4B, is maximum at a support position facing to the upstream side end B of the coating operation surface 35. Compared to the case of the first embodiment shown in FIG. 2B, the pressure distribution is linear particularly in a section BC. Thus, with variations of the coating operation conditions, the pressure of the magnetic dispersoid is held within the range as shown by the dashed curve. It is thus possible to further extend the coating operation condition ranges that permit satisfactory coating.

Fourth Embodiment

Figure 5A:
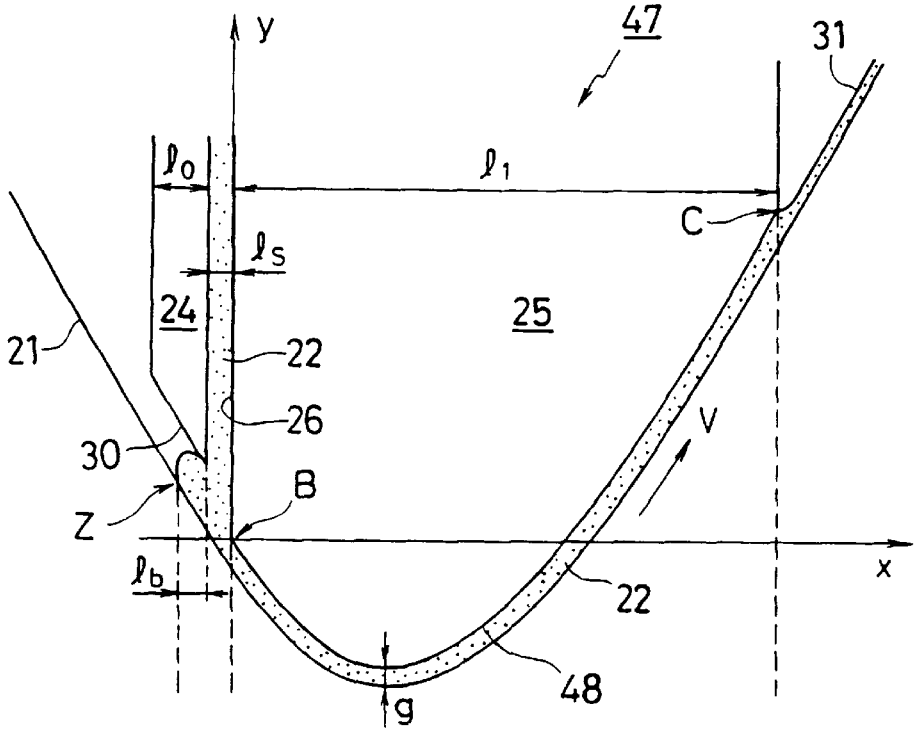
FIG. 5A is a sectional view showing a die head in a fourth embodiment of the invention.
Figure 5B:
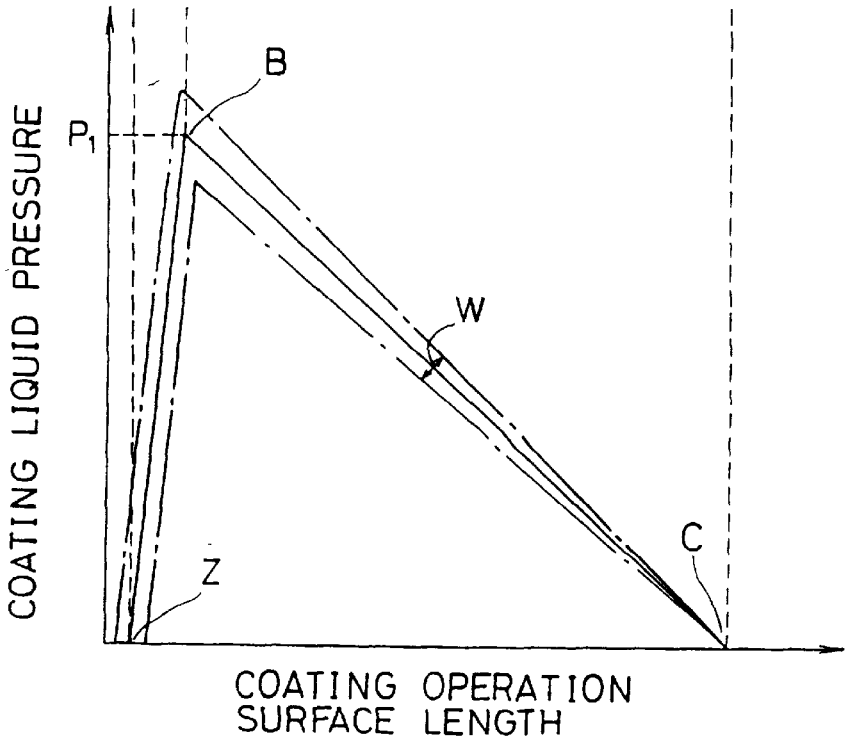
FIG. 5B is a graph showing the relation between coating liquid pressure and coating operation surface length in the coating apparatus shown in FIG. 5A.

FIG. 5A is a sectional view showing a portion of a die head in a fourth embodiment of the coating apparatus according to the invention. FIG. 5B is a graph showing the relation between the pressure acted on support 21 by coating liquid extruded into the space between coating operation surfaces 30 and 48 and the support 21 shown in FIG. 5A and the length of the coating operation surface. In this fourth embodiment, parts like those in the first embodiment are designated by same reference numerals and symbols, and their description is omitted.

In this fourth embodiment of the coating apparatus 47, the coating operation surface 48 of downstream lip 25 is curved to be convex toward the support 21. The shape of the coating operation surface 48 is expressed by a cubic function $$y = ax^3 + bx^2 + cx \text{ (a, b and c being constants)}$$

in coordinates with the origin taken as the upstream end B of the downstream lip, the x axis taken to be parallel to the tangent M to the two guide rollers 19 with the downstream side direction being the positive direction, and the y axis taken to be perpendicular to the x axis, with the direction opposite to the direction of coating liquid extrusion from the slot 26 being the positive direction.

The equation can be derived analytically if the coating operation surface and the support are assumed to be parallel and the rigidity of the support is assumed to be very low.

The constants a, b and c in the above cubic function are given as $$a = \frac{P_1}{\rho V^2 - T}\left(\frac{1}{6l_1}\right) \tag{1}$$

$$b = \frac{P_1}{\rho V^2 - T}\left(-\frac{1}{2}\right)$$

$$c = \frac{P_1}{\rho V^2 - T}\left(\frac{1}{4}(l_1 - l_b - l_s) + \frac{1}{12L_R}(l_1 + l_b + l_s)(l_1 + 2(l_b + l_s))\right)$$

where $P_1$ is the maximum pressure of the magnetic dispersoid 22 extruded into between the coating operation surface 48 and the support 21, ρ is the nominal surface density of the support 21 (ρ=ρf+ρd, ρf: surface density of the support 21, ρd: the surface density of the magnetic dispersoid 22 extruded into between the coating operation surface 48 and the support 21), V is the running speed of the support 21 (i.e., coating speed), $l_1$ is the length of the downstream lip 25, $l_s$ is the width of the slot 26, and $l_b$ is the bead length of the magnetic dispersoid 22 extruded into between the lip surface 30 of the upstream lip 24 and the support 21.

Further, in a thin film coating or where the coating speed is comparatively low, the inertia term ($\rho V^2$) in the equation (1) can be neglected, and thus it is possible to use the following equation (2) in lieu of the above equation (1).

$$a = \frac{P_1}{-T}\left\{\frac{1}{6l_1}\right\}$$

$$b = \frac{P_1}{-T}\left\{-\frac{1}{2}\right\}$$

$$c = \frac{P_1}{-T}\left\{\frac{1}{4}(l_1 - l_b - l_s) + \frac{1}{12L_R}(l_1 + l_b + l_s)(l_1 + 2(l_b + l_s))\right\}$$

These constants are set to, for instance, a=−0.511, b=0.766 and c=−0.181 (in this case y and x are shown in mm.).

Thus, the pressure acting on the support 21 by the magnetic dispersoid 22 extruded into the space between the coating operation surface 29 of the downstream lip 25 and the support 21, as shown by the solid line in FIG. 5B, has the maximum value $P_1$ at a support position facing to the upstream end B of the coating operation surface 29 (i.e., the open end of the slot 26) and is reduced linearly toward the downstream side to be minimum at a support position facing to the downstream end C of the coating operation surface 29. It is also minimum at the upstream end Z of the bead.

Thus, even when the coating operation conditions such as the coating speed, coating film thickness, kind of coating, etc. are varied, changes in the pressure between coating operation surface 48 of the downstream lip 25 and the support 21 can be held within a small range as shown by the dashed lines in FIG. 5B. Besides, the pressure distribution is held linear and very stable. It is thus possible to extend the coating operation condition ranges that permit satisfactory coating.

Fifth Embodiment

Figure 6A:
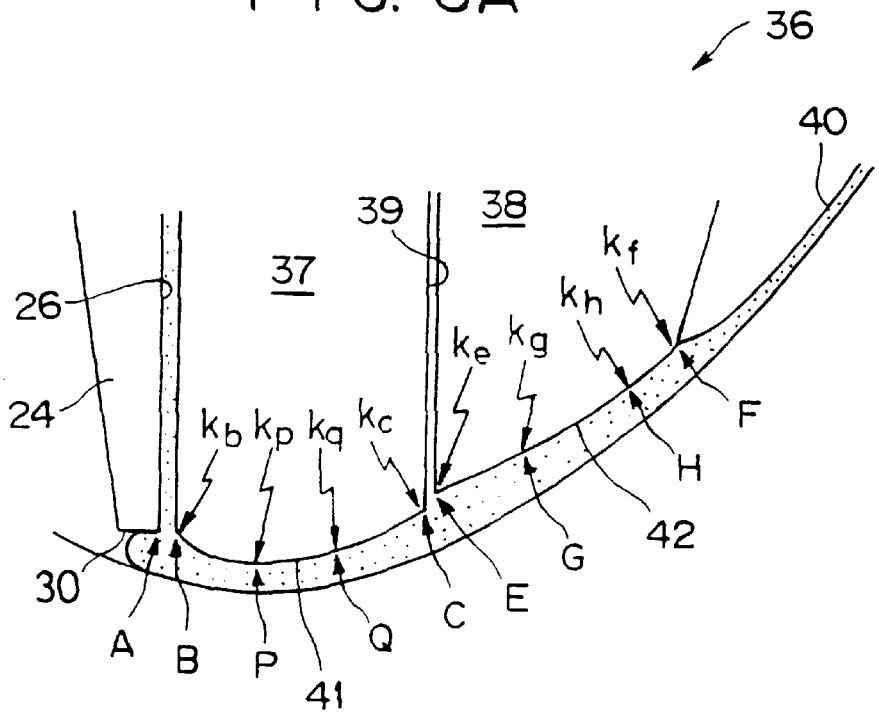
FIG. 6A is a sectional view showing a die head in a fifth embodiment of the invention.
Figure 6B:
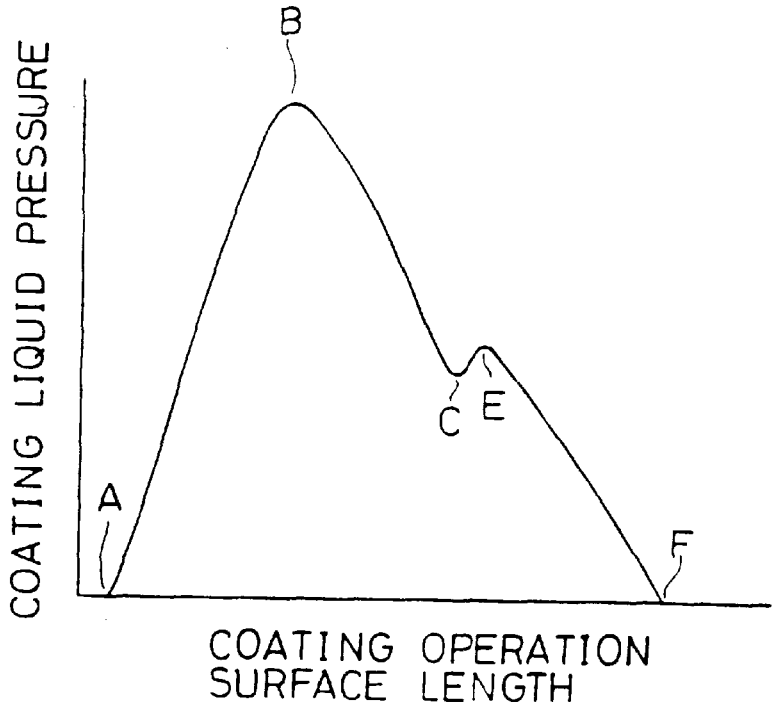
FIG. 6B is a graph showing the relation between coating liquid pressure and coating operation surface length in the coating apparatus shown in FIG. 6A.

FIG. 6A is a sectional view showing a portion of a die head in a fifth embodiment of the coating apparatus according to the invention. FIG. 6B is a graph showing the relation between the pressure of the coating liquid 22 extruded into the space between coating operation surfaces 30, 41 and 42 shown in FIG. 6A and support 21 and the coating operation surface length. In this fifth embodiment, parts like those in the previous first embodiment are designated by same reference numerals and symbols, and their description is omitted.

In this fifth embodiment of the coating apparatus 36, the downstream lip is constituted by first and second downstream lips 37 and 38 with a second slot 39 defined therebetween. The first downstream lip 37 is disposed near and defines the slot 26 with upstream lip 24, and the second downstream lip 38 is disposed near and defines the second slot 39 with the first downstream lip 37. In this embodiment, the slot 26 is hereinafter referred to as first slot 26.

The same or different kinds of magnetic dispersoid 22 are extruded from the first and second slots 26 and 39, and coated on the support 21, thus forming a double layer coating film 40.

The coating operation surfaces 41 and 42 of the first and second downstream lips 37 and 38 are curved to be convex toward the support 21. The coating operation surface 41 is similar to the coating operation surface 35 in the third embodiment. That is, the curvature $k_p$ and $k_q$ of given points P and Q on the coating operation surface 41 are set to be $$k_p \geqq k_q,$$

$$P_2/T \leqq k_p \leqq P_1/T$$

and $$P_2 T \leqq k_q \leqq P_1/T.$$

Further, the curvatures $k_b$ and $k_c$ of the upstream and downstream ends B and C of the coating operation surface 41 are set to be $$k_b = P_1/T$$

and $$k_c = P_2/T.$$

As for the coating operation surface 42, the of curvature $k_g$ of given point G and the curvature $k_h$ of given point H positioned downstream to point G on the surface 42 are set to be $$k_g \geqq k_h.$$

Further, these curvatures $k_g$ and $k_h$ are set as $$P_4/T \leqq k_g \leqq P_3/T$$

and $$P_4/T \leqq k_h \leqq P_3/T,$$

where $P_3$ and $P_4$ are pressures of the magnetic dispersoid 22 at the upstream and downstream ends E and F of the coating operation surface 42, and T is the tension of the support 21. Further, the curvatures $k_e$ and $k_f$ of the upstream and downstream ends E and F of the coating operation surface 42 are set to $$k_e = P_3/T$$

and $k_f = P_4/T.$

The individual curvatures $k_h$, $k_g$, $k_e$ and $k_f$ are set to satisfy the above equations and vary along the length of surface 38 continuously.

Thus, again in this fifth embodiment, the pressure acting on the support 21 by the magnetic dispersoid 22 extruded into the space between the coating operation surfaces 41 and 42 and the support 21, as shown in FIG. 6B, is high at a support position facing to the first slot 26 and gradually reduced in the running direction of the support 21 (while it is slightly increased at a support position facing to the second slot 39). Thus, again in this fifth embodiment, like the first embodiment, it is possible to extend the coating operation condition ranges permitting realization of satisfactory coating.

While in the fifth embodiment, both the coating operation surfaces 41 and 42 of the first and second downstream lips 37 and 38 were curved, it is also possible that the one coating operation surface 41 is curved while the other coating operation surface 42 is flat. Conversely, the coating operation surface 41 may be flat while the coating operation surface 42 is curved.

Further, while this embodiment concerned with the case with two downstream lips, the same effects are obtainable with the provision of three or more downstream lips for forming a multiple layer coating having three or more layers.

Sixth Embodiment

Figure 7A:
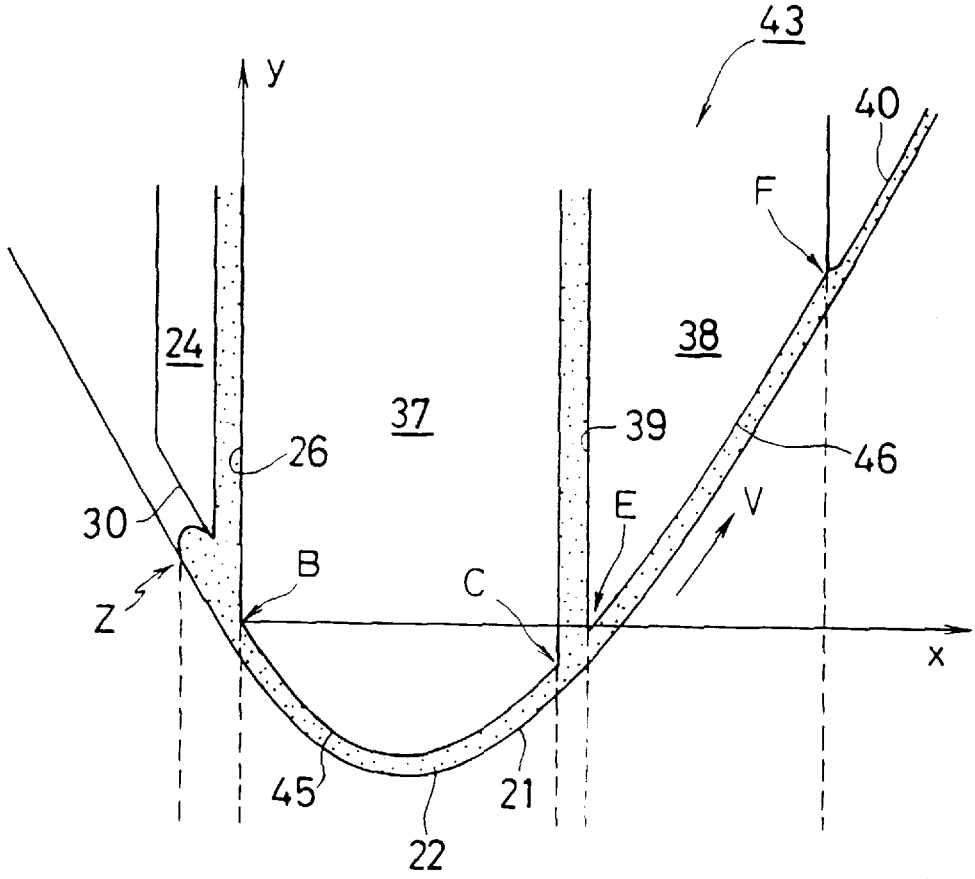
FIG. 7A is a sectional view showing a die head in a sixth embodiment of the invention.
Figure 7B:
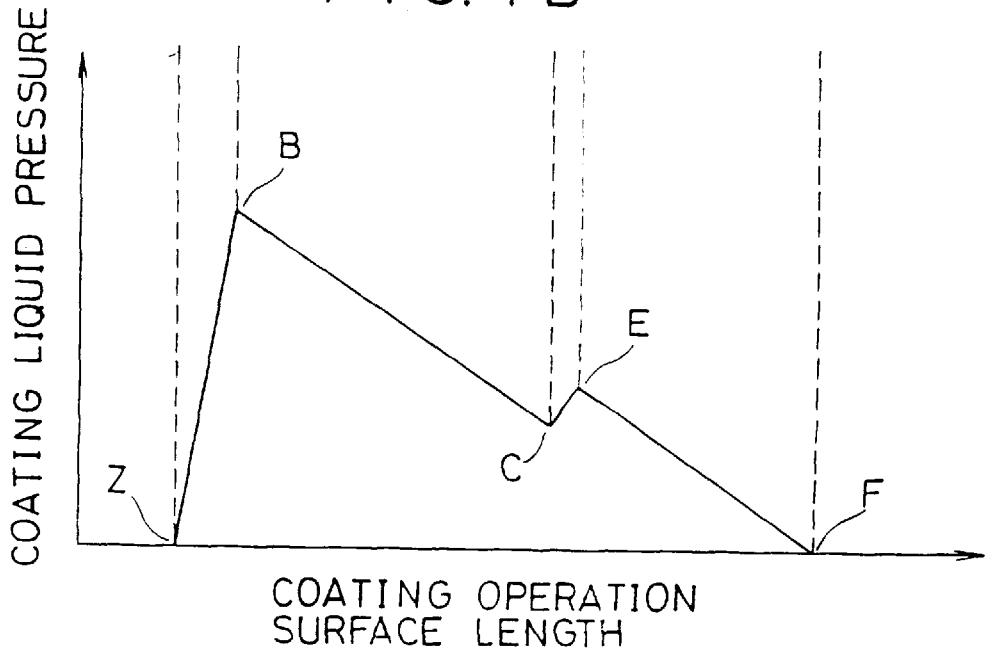
FIG. 7B is a graph showing the relation between coating liquid pressure and coating operation surface length in the coating apparatus shown in FIG. 7A.
Figure 8A:
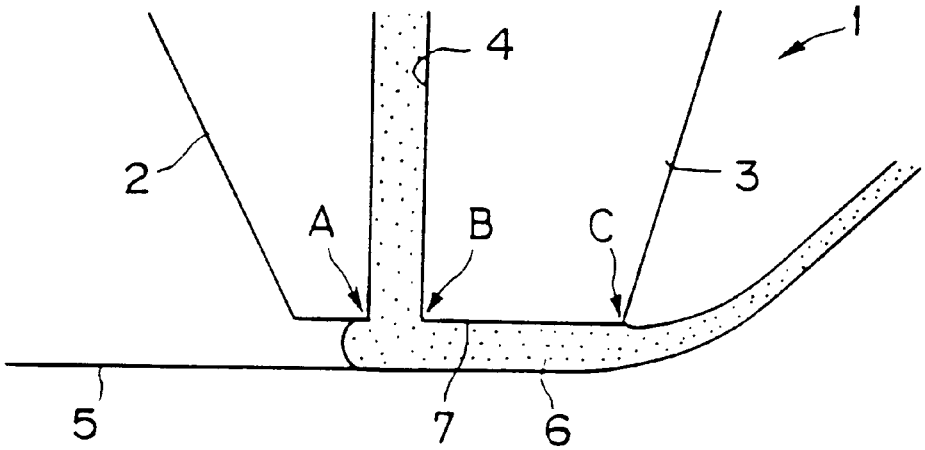
FIG. 8A PRIOR ART
FIG. 8A is a sectional view showing a die head end of a first prior art example.
Figure 8B:
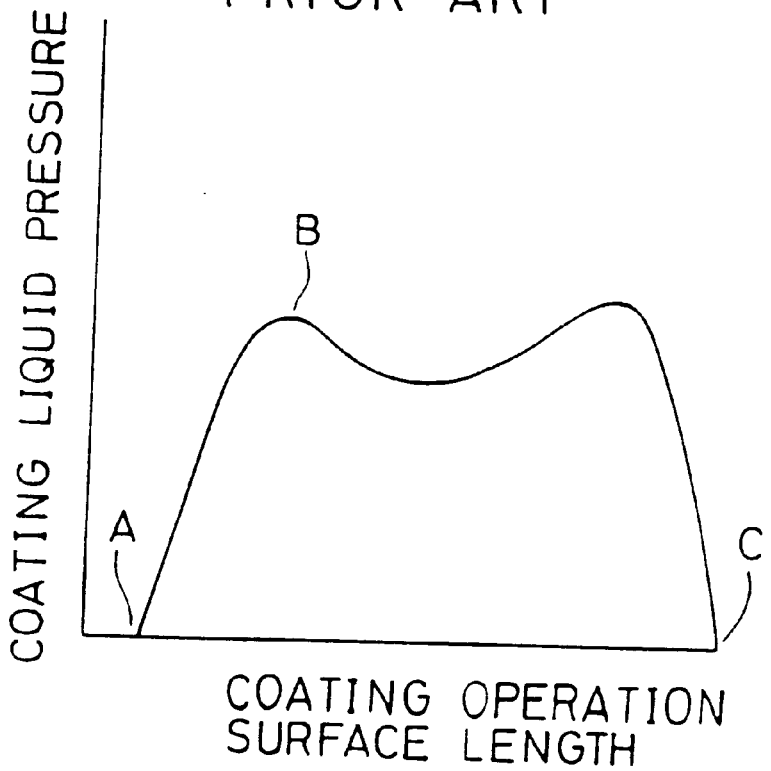
FIG. 8B PRIOR ART
FIG. 8B is a graph showing the relation between coating liquid pressure and coating operation surface length in the coating apparatus shown in FIG. 8A.
Figure 9A:
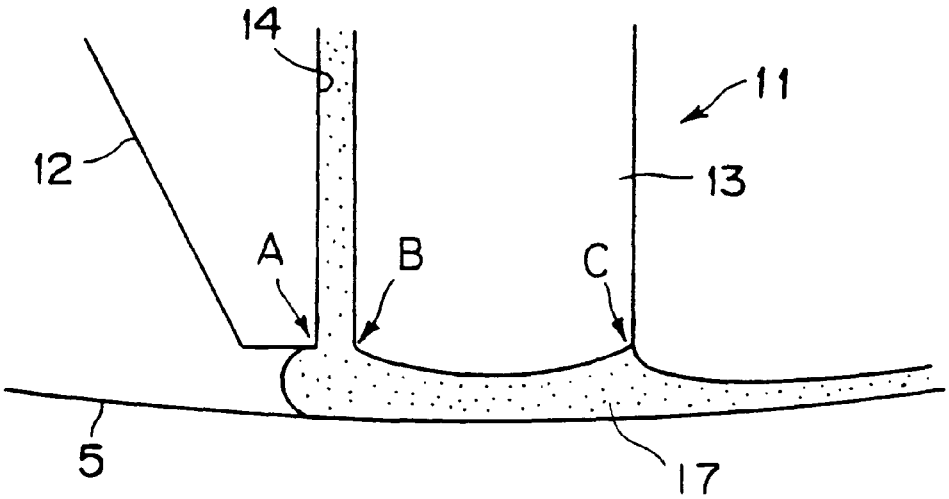
FIG. 9A PRIOR ART
FIG. 9A is a sectional view showing a die head end of a second prior art example.
Figure 9B:
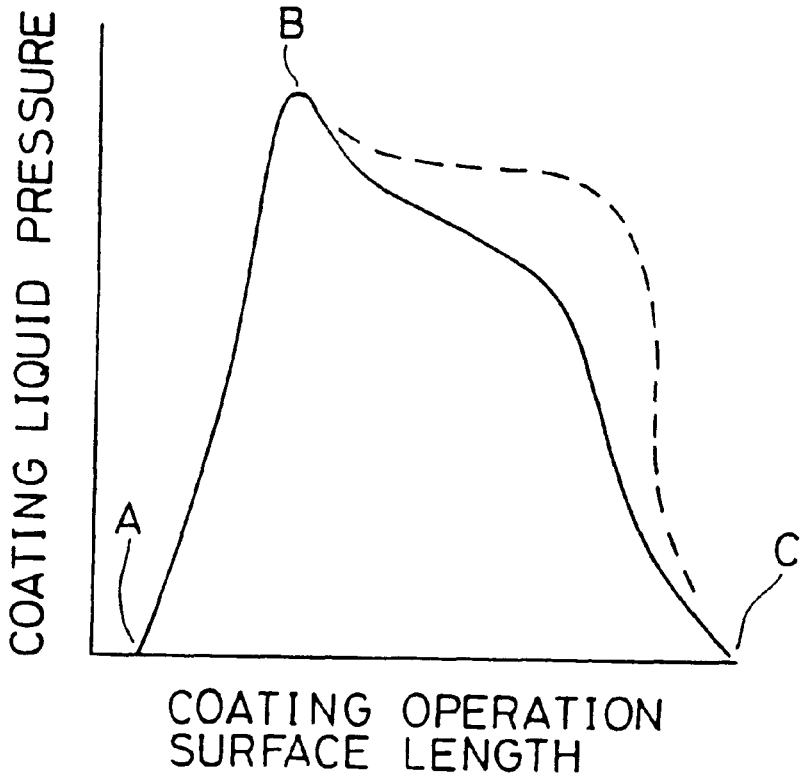
FIG. 9B PRIOR ART
FIG. 9B is a graph showing the relation between coating liquid pressure and coating operation surface length in the coating apparatus shown in FIG. 9A.

FIG. 7A is a sectional view showing a portion of a die head in a sixth embodiment of the coating apparatus according to the invention. FIG. 7B is a graph showing the relation between the pressure of the coating liquid extruded into the space between coating operation surfaces 30, 45 and 46 and support 21 shown in FIG. 7A and the coating operation surface length. Parts like those in the fifth embodiment are designated by same reference numerals and symbols, and their description is omitted.

This embodiment of the coating apparatus 43, like the fifth embodiment, is a coating apparatus for simultaneously coating multiple layers. However, like the previous fourth embodiment, the individual coating operation surfaces have shapes expressed as a cubic function. More specifically, the coating operation surfaces 45 and 46 of first and second downstream lips 37 and 38 have shapes expressed as a cubic function $y = ax^3 + bx^2 + cx$ (a, b and c being constants)

in coordinates with the origin taken as the upstream end B of the first downstream lip 37, the x axis taken to be parallel to the coating side tangent M to the two guide rollers 19, and the y axis taken to be perpendicular to the x axis, with the direction opposite to the direction of coating liquid extrusion from the slot 26 being positive.

Thus, again in this sixth embodiment, the pressure acted on the support 21 by the magnetic dispersoid 22 extruded into the space between the coating operation surfaces 45 and 46 and the support 21 is maximum at a support position facing to the upstream end B of the first downstream lip 37 and slightly increased at a support position facing to the upstream end E of the second downstream lip 38, but is reduced substantially linearly in the running direction of the support 22 and is minimum at the downstream end F of the second downstream lip 37. Thus, again in the sixth embodiment, it is possible to extend the coating operation condition ranges that permit satisfactory coating.

In the above sixth embodiment, the coating operation surfaces 45 and 46 of the first and second downstream lips 37 and 38 had shapes expressed by the same cubic function. However, only either one of the coating operation surfaces 45 or 46 may have the shape expressed by the above cubic function. As a further alternative, these coating operation surfaces 45 and 46 may have shapes expressed by cubic functions with different constants a, b and c.

As has been described in the foregoing, with the coating apparatus according to the invention, it is possible to extend the coating operation condition ranges that permit satisfactory coating to be realized.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed as new and desired to be secured by Letters Patent of the United States is:

1. A coating apparatus comprising:

an upstream lip and at least two downstream lips, slots being formed between adjacent lips through which a coating liquid can be extruded forming a coating film consisting of at least two layers; and a pair of guide rollers disposed on opposite sides of said lips for guiding a support to move past said lips such that the coating liquid can be applied thereto, wherein at least one of said downstream lips has a coating operation surface facing and curved toward said support and for any two points on said surface of said downstream lip, a curvature $k_p$ of an upstream point of said surface and a curvature $k_q$ of a downstream point of said surface are set as $P_2/T \leqq k_q \leqq k_p \leqq P_1/T$ where T represents the tension in the coated portion of said support, and $P_1$ and $P_2$ represent the pressures of the coating liquid acting on said support at upstream and downstream ends of said coating operation surface.

* * * * *